US010710854B2

(12) United States Patent
Robolotti et al.

(10) Patent No.: US 10,710,854 B2
(45) Date of Patent: Jul. 14, 2020

(54) REACH TRUCK

(71) Applicant: NACCO Materials Handling Group, Inc., Fairview, OR (US)

(72) Inventors: Franco Robolotti, Milan (IT); Riccardo Appiani, Monza (IT)

(73) Assignee: HYSTER-YALE GROUP, INC., Fairview, OR (US)

( * ) Notice: Subject to any disclaimer, the term of this patent is extended or adjusted under 35 U.S.C. 154(b) by 1076 days.

(21) Appl. No.: 14/504,306

(22) Filed: Oct. 1, 2014

(65) Prior Publication Data

US 2015/0098780 A1 Apr. 9, 2015

(30) Foreign Application Priority Data

Oct. 7, 2013 (EP) ..... 13187534

(51) Int. Cl.
*B66F 9/22* (2006.01)
*B66F 9/10* (2006.01)

(52) U.S. Cl.
CPC . *B66F 9/22* (2013.01); *B66F 9/10* (2013.01)

(58) Field of Classification Search
CPC ..... B66F 9/10; B66F 9/122; B66F 9/22
See application file for complete search history.

(56) References Cited

U.S. PATENT DOCUMENTS 3,082,894 A 3/1963 Gibson
3,231,109 A * 1/1966 Bengel ..... B66F 9/07559 180/216
4,182,126 A * 1/1980 Blakeslee ..... B66F 9/22 318/601
5,011,363 A * 4/1991 Conley, III ..... B66F 9/10 180/315

(Continued)

FOREIGN PATENT DOCUMENTS

DE 102008031347 A1 1/2010
EP 0199116 A1 10/1986

(Continued)

OTHER PUBLICATIONS

European Search Report for EP13187534.6—1705, Mar. 3, 2014.

*Primary Examiner* — James Keenan
(74) *Attorney, Agent, or Firm* — Schwabe Williamson & Wyatt

(57) ABSTRACT

A reach truck 1, comprising a main body 10, at least one load arm 70, which protrudes from the main body 10, a mast trolley 20, which is supported at the at least one load arm 70, wherein the mast trolley 20 is shift-able along a longitudinal axis 100 of the reach truck 1 relative to the main body 10, a mast 30, which is attached to the mast trolley 20, a linear actuator 50, for shifting the mast trolley 20 along the longitudinal axis 100 relative to the main body 10, wherein the linear actuator 50 is attached at a first end 52, A thereof to the main body 10 and at a second end 54, C thereof to the mast trolley 20, and the linear actuator 50 is arranged (Continued)

Figure 1A:
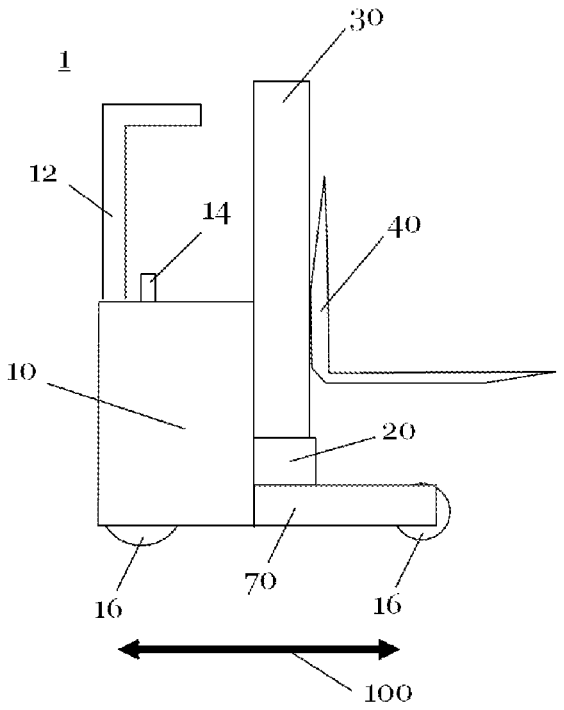

inclined to the longitudinal axis 100 of the reach truck 1 and defines a first angle α between the extension direction of the linear actuator 50 and the longitudinal axis 100, wherein the first angle α changes depending on the position of the mast trolley 20 relative to the main body 10, and the reach truck 1 further comprises a sensor 60, for determining the angular position of the linear actuator 50.

14 Claims, 5 Drawing Sheets

(56) References Cited

U.S. PATENT DOCUMENTS 5,022,496 A * 6/1991 Klopfleisch ..... B66F 9/20 187/224
5,346,356 A * 9/1994 Eriksson ..... B66F 9/10 414/544
6,135,694 A * 10/2000 Trego ..... B66F 9/24 414/21
6,945,745 B2 * 9/2005 Retzlaff ..... B66F 9/082 187/226
7,036,233 B1 * 5/2006 Schindler ..... G01B 7/31 33/1 PT
7,599,777 B2 * 10/2009 Passeri ..... B66F 9/147 187/222
9,206,024 B2 * 12/2015 Yahner ..... B66F 9/0755
2003/0024132 A1 * 2/2003 Kokura ..... B66F 9/0755 33/712
2015/0100210 A1 * 4/2015 Hoock ..... B66F 9/10 701/50

FOREIGN PATENT DOCUMENTS

JP 2013049533 A 3/2013
WO WO 9606795 A1 * 3/1996 ..... B66F 9/24

* cited by examiner

REACH TRUCK

1. FIELD OF THE INVENTION

The present invention relates to a reach truck, in particular a reach truck for the movement of goods on pallets in a factory, warehouse, supermarket and the like.

2. PRIOR ART

Reach trucks are commonly known in the prior art. A reach truck differs from forklift trucks and handlift trucks in that a fork for the support of a pallet of goods is not rigidly fixed to a main body, but may be shifted along a longitudinal axis relative to the main body.

To this end the mast is attached to a mast trolley, wherein the mast trolley can be moved along the longitudinal axis of the reach truck relative to the main body. Usually the mast trolley is supported and guided by rails. The force for the movement along the longitudinal axis of the reach truck is applied in commonly known reach trucks by a hydraulic piston or by an electro-mechanic actuator. This allows a very energy-efficient shifting of the mast trolley.

The control information, how the mast trolley has to be positioned relative to the main body is usually provided by manual commands of a user.

For safety matters in view of the user, the reach truck and the goods, it is necessary that the mast trolley moves only in a predetermined section of the tracks. This section defines the admissible range of movement of the mast trolley. The admissible range of movement is limited at a first end thereof by the main body itself or the battery pack used and at a second end thereof by a mechanical end stop. Problems occur when the mast trolley hits with maximum speed one of the mechanical end stops of the range of movement. In such an undesired case the movement would stop suddenly, wherein the loaded goods may still move forward due to their mass inertia and thus they may slip off the fork in the worst case. Moreover, a damage of the main body, the battery pack, the mast trolley or the mast may appear, when the mast trolley hits the main body with maximum speed.

DE 10 2001 018 506 A1 provides a mechanical end stop for a mast trolley in order to prevent the mast trolley from hitting a main body directly, wherein the current position of the mast trolley is unknown to a control unit during the movement of the mast trolley. The disclosed mechanical end stops, so called spacers, are provided at the rear end of the mast trolley, which is the end of the mast trolley that faces towards the base member. A length of the spacer is predetermined by the mast trolley, by the drive and the fork assembly uses in the specific use case. Therefore, the prior art allows to change the mechanical end stops, when the use case changes. However, to do so it is always necessary to disassemble some parts of the reach truck. This approach is in particular inflexible and time-consuming. Moreover, this approach does not solve the problem that the reach truck still moves to the end stops with full speed.

DE 10 2008 031 347 A1 discloses a reach truck, comprising a sensor or switch, which provides an end position signal to a control device in order to reduce a pressure in an extension cylinder or sets this pressure to zero, when a slide reaches a predetermined position. However, the actual position of the mast trolley is unknown to a control unit of the reach truck during the movement of the mast trolley. By the reach truck of DE 10 2008 031 347 A1, it is possible to define an end position proximate to both ends of an admissible range of movement. By this end position the speed of the slide can be reduced before a mechanically defined end of the admissible range of movement is reached. As mentioned above, the admissible range of movement is amongst others determined by the current use case and physical configuration of the tracks and main body, such as, but not limited to, the battery box of the reach truck. Therefore, it will be necessary to readjust the admissible range of movement due to different tasks and physical arrangements of reach trucks. In the DE 10 2008 031 347 A1 this has to be done by repositioning of the sensors or switches for example, during manufacture of a reach truck. Thus, also this solution is inflexible and time-consuming.

3. SUMMARY OF THE INVENTION

In particular, the above-mentioned problems are solved by a reach truck, comprising a main body, at least one load arm, which protrudes from the main body, a mast trolley, which is supported at the at least one load arm, wherein the mast trolley is shift-able along a longitudinal axis of the reach truck relative to the main body, a mast, which is attached to the mast trolley, a linear actuator, for shifting the mast trolley along the longitudinal axis relative to the main body, wherein the linear actuator is attached at a first end thereof to the main body and at a second end thereof to the mast trolley and the linear actuator is arranged inclined to the longitudinal axis of the reach truck and defines a first angle between the extension direction of the linear actuator and the longitudinal axis, wherein the first angle changes depending on the position of the mast trolley relative to the main body and the reach truck further comprises a sensor, for determining the angular position of the linear actuator.

Some embodiments provide a reach truck which is able to define end positions in a flexible and easy manner in order to improve the operation and comfort of the reach truck during use. Other embodiments provide a reach truck, wherein the mast trolley movement can be controlled over the complete range of movement.

The linear actuator is arranged inclined to the longitudinal axis of the reach truck. Due this arrangement, the linear actuator rotates around a vertical axis during the movement of the mast trolley. In particular, the first angle becomes larger, when the mast trolley moves forward along the longitudinal axis of the reach truck. This variation of the first angle is measured by means of the sensor. The measured first angle allows the determination of the actual position of the mast trolley relative to the base member. This is in particular advantageous, since it is now possible for the first time to determine the actual position of the mast trolley at any point of time or at any arbitrary position of the mast trolley. Moreover, it is therefore possible for the first time to provide a closed control loop, which controls the movement of the mast trolley over the complete range of movement. Contrary to the prior art, where only some few specific positions, like end positions, may be detected, described embodiments of reach trucks are able to use information about the actual position of the mast trolley of the reach truck for control matters, safety matters and automation matters, whenever they are needed and irrespective of the current position of the mast trolley relative to the main body. In order to provide a soft-stop functionality for the mast trolley the actual end positions of the mast trolley can be communicated to the control electronics by a simple teach-in step. No end switches or sensors need to be adjusted. A continuous measurement of the position of the mast trolley also allows for other applications like vibration cancelling of the mast or the like.

The linear actuator of the reach truck according to the invention is able to rotate around the above-mentioned vertical axis, which is preferably realized by a hinge between the linear actuator and the main body and respectively between the linear actuator and the mast trolley.

The sensor is preferably any sensor, which is appropriate for determining the angular position of the linear actuator, like for instance an angle sensor or a length measuring device. Since the points are known, where the linear actuator is attached to the main body and to the mast trolley and since the mast trolley is only shift-able along the longitudinal axis of the reach truck relative to the main body, it is possible to determine the actual position of the mast trolley relative to the main body. This arrangement is in particular advantageous since it is not necessary to provide measuring devices along the entire admissible range of movement of the mast trolley. Neither it is necessary to provide a measuring device, which spans over the entire range of movement of the mast trolley, which would be very maintenance-intensive, expensive and fault-prone. Further, the measuring results would likely have a high measuring uncertainty due to the effect of dirt, abrasion and the like. However, due to the inclined arrangement of the linear actuator, the sensor according to the present invention can be more precise, less maintenance-intensive and will have only a small measurement uncertainty.

Preferably, the linear actuator is a hydraulic piston that is controlled by an electronic proportional hydraulic valve.

A hydraulic piston is in particular advantageous, since it allows to provide a high force for shifting the mast trolley along the longitudinal axis of the reach truck relative to the main body, wherein the piston is very energy efficient for providing the necessary force. The electronic proportional valve allows the piston to be controlled in a continuous manner with any desired speed. While other valves only allow to "switch between discrete positions", like completely open or completely closed, a proportional valve is able to provide a continuous range of "opening positions" between these two extreme values. Therefore, it is possible to realize continuous movement profiles of the mast trolley in order to achieve optimum results in view of work efficiency on the one hand and load safety on the other hand.

Preferably, the sensor is a length measuring device, which is hinged at a first end thereof to the main body and at a second end thereof to the linear actuator. The length measuring device may be any length measuring device, which is suitable for measuring a distance between a fixed point of the main body and a predetermined moving point of the longitudinal actuator. Since the distance between the first end of the length measuring device and the predetermined point of the linear actuator is known and the distance between the fixed point of the main body (that is the position of a hinge by which the first end of the length measuring device is hinged to the main body) is known and since a second angle between the longitudinal axis of the reach truck and the first end of the length measuring device is known, it is possible to determine the first angle between the extension direction of the linear actuator and the longitudinal axis. This is in particular advantageous, since length measuring devices are very precise and very insensitive in view of environmental impacts like vibration, dirt, abrasion and the like.

Preferably, the measuring direction of the length measuring device differs from the extension direction of the linear actuator. This measure is in particular advantageous since it is therefore possible to use length measuring devices with a range of measurement which is significantly smaller than the range of movement of the mast trolley. Thus, length measuring devices with a smaller range of measurement may be used, which are commonly less expensive than length measuring devices with a larger range of measurement. As mentioned above and as it will be explained in more detail below, it is possible to gather the angular position of the linear actuator from the measurement result of the length measuring device.

Preferably, the position of the mast trolley along the longitudinal axis relative to the main body is calculated as follows:

$$d = \frac{a}{\tan\alpha},$$

wherein $\alpha$ is a distance between the longitudinal axis, which goes through the first end of the linear actuator and the second end of the linear actuator. Thus, it is possible to determine the position d of the mast trolley by the use of the determined angle $\alpha$. The distance a is known from the technical specification, since attachment points of the linear actuator, which are preferably realized by hinges, are fixed in their positions at the main body and the mast trolley, respectively.

Preferably, the first angle $\alpha$ is calculated as follows:

$$\alpha = \arccos\left(\frac{x^2 + z^2 - y^2}{2xz}\right) - \beta,$$

wherein x is a distance between the first end of the linear actuator and the first end of the length measuring device, y is a length, which is detected by the length measuring device, which is a distance between the first end of the measuring device and the second end of the measuring device, z is a distance between the first end of the linear actuator and the second end of the length measuring device in the extension direction of the linear actuator and $\beta$ is a second angle, which is the angle between the longitudinal axis, which goes through the first end of the linear actuator, and x. By the use of the above-mentioned equation, it is possible to determine the first angle $\alpha$ by means of the length y, which is detected by the length measuring device. All other variables, namely x, z and $\beta$ are parameters, which are known from the technical specification or design of the reach truck: The first end of the linear actuator is preferably hinged at the main body, wherein the position of the hinge is fixed. The second end of the linear actuator is hinged at the mast trolley, wherein the second end of the linear actuator is fixed in its position at the mast trolley by a hinge.

As already mentioned above, also the first end of the measuring device is fixed in its position at the main body, wherein the length measuring device is able to rotate around a vertical axis of the hinge. Thus, also the second angle $\beta$ is known from the technical specification or design of the reach truck, since the longitudinal axis of the reach truck, the position of the first end of the linear actuator and the position of the first end of the measuring device are known and do not change. Thus, it is possible to determine the position of the mast trolley relative to the main body by the use of a measuring method continuously. This allows the determination and use of the actual position of the mast trolley by an indirect length measuring which is more secure, more flexible and more cost efficient compared to end stop sensors or switches.

Preferably, the reach truck further comprises a control unit for automatically controlling a maximum movement speed of the mast trolley, depending on the position of the mast trolley along the longitudinal axis relative to the main body. Since the position of the mast trolley along the longitudinal axis is known at any desired point of time, it is now possible for the first time to control the maximum movement speed of the mast trolley by a closed control loop, which comprises the control unit, the linear actuator and the length measuring device. This maximizes loading and unloading speed and inhibits load shifting, mast oscillation and undesirable effects of sudden stopping of the mast since an automatic soft stop of the mast trolley can be implemented. In this case the user simply moves the mast trolley with full speed and it will be automatically softly stopped at the end of the movement range.

Preferably, the control unit calculates the position of the mast trolley along the longitudinal axis relative to the main body from information received from the sensor. This information can be used for further calculations and to apply a certain maximum velocity curve. Additionally position of the mast trolley can be displayed to a user.

Preferably, the control unit automatically controls a maximum movement speed of the mast trolley depending on the position of the mast trolley along the longitudinal axis relative to the main body according to a predetermined profile. This is in particular advantageous in order to implement an automatic soft stop functionality which minimizes trolley movement time.

In another preferred embodiment, the sensor is an angle sensor. In this embodiment, the angular position of the linear actuator is directly determined by the angle sensor. This is in particular advantageous, if in the specific use case of this embodiment of a reach truck wherein the angular position of the linear actuator may be directly used for the internal control of the mast trolley Preferably, the angle sensor is attached near to the first end or near to the second end of the linear actuator. In this preferred embodiment, the angle sensor, such as angle sensor 53, is attached on or in the proximity of one of the hinges that connect the first end of the linear actuator with the main body and the one, which connects the second end of the linear actuator with the mast trolley. Alternatively, it is also possible to determine the angular position of the linear actuator, e. g. by the use of optical detection systems. However, it is most preferred to provide the angle sensor on top the hinge, which connects the first end of the linear actuator with the main body, since this end of the linear actuator is fixed in its location in view of the main body and thus ridgid connection lines may be provided that allow a simple and reliable mounting of data- and power-lines of the angle sensor.

Preferably, the angular position of the linear actuator and/or the position of the mast trolley along the longitudinal axis relative to the main body is continuously detected during the movement. The continuous detection of the angular position of the linear actuator and/or the position of the mast trolley along the longitudinal axis allows to continuously track and control the movement of the mast trolley of the reach truck. Thus, the highest form of control is reached, since the continuous detection leads to a continuous control of the mast trolley over the full range of movement.

Preferably, the control unit continuously controls the maximum movement speed of the mast trolley depending on the continuously detected position of the mast trolley along the longitudinal axis. By the above-mentioned continuous closed control loop it is possible to define movement profiles of the mast trolley depending on the specific task. Thus, it is for instance possible to define an exponential increase of the maximum speed at the beginning of the movement, a continuous phase in the middle and again an exponential decrease of the maximum possible speed for braking of the mast trolley, when it reaches the end of the movement range. However, it is also possible to define any movement profile with varying movement speeds during the movement range. This is in particular important for the transport of liquids, which are transported in one unitary huge tank and thus might lead to dangerous situations in the view of the stability of the reach truck, when the liquid starts to move.

4. BRIEF DESCRIPTION OF THE DRAWINGS

Figure 1B:
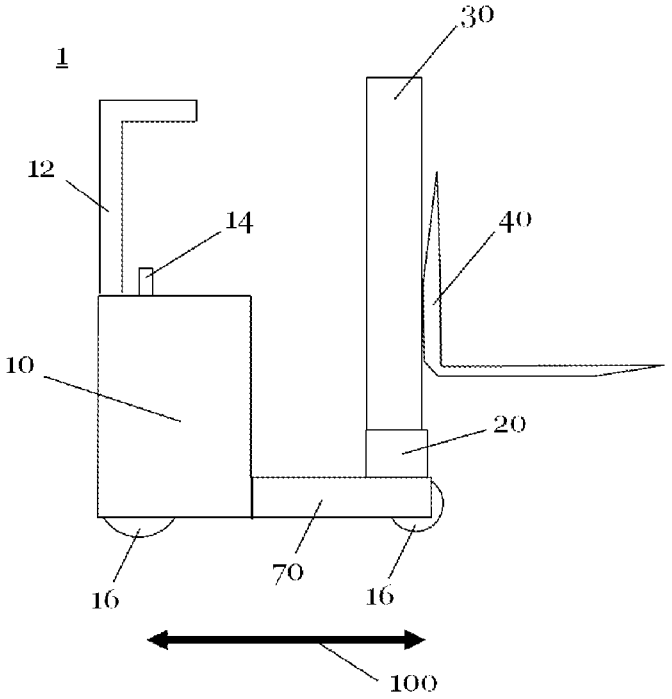
Figure 2A:
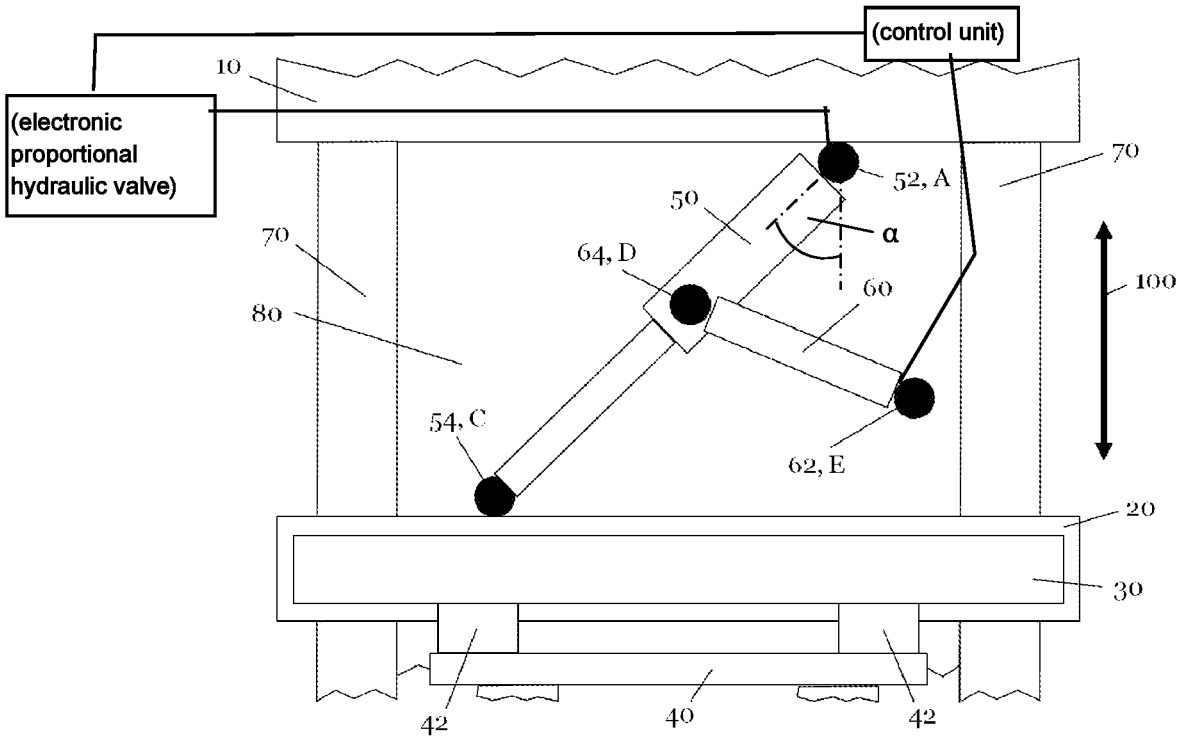
Figure 2B:
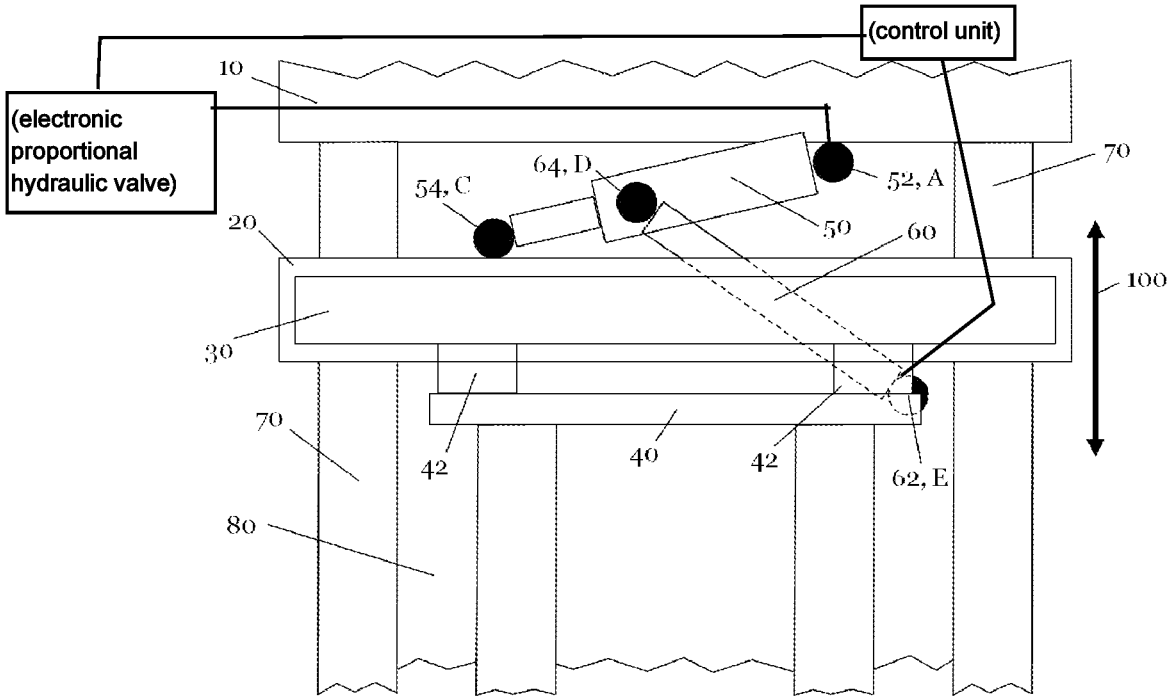
Figure 2C:
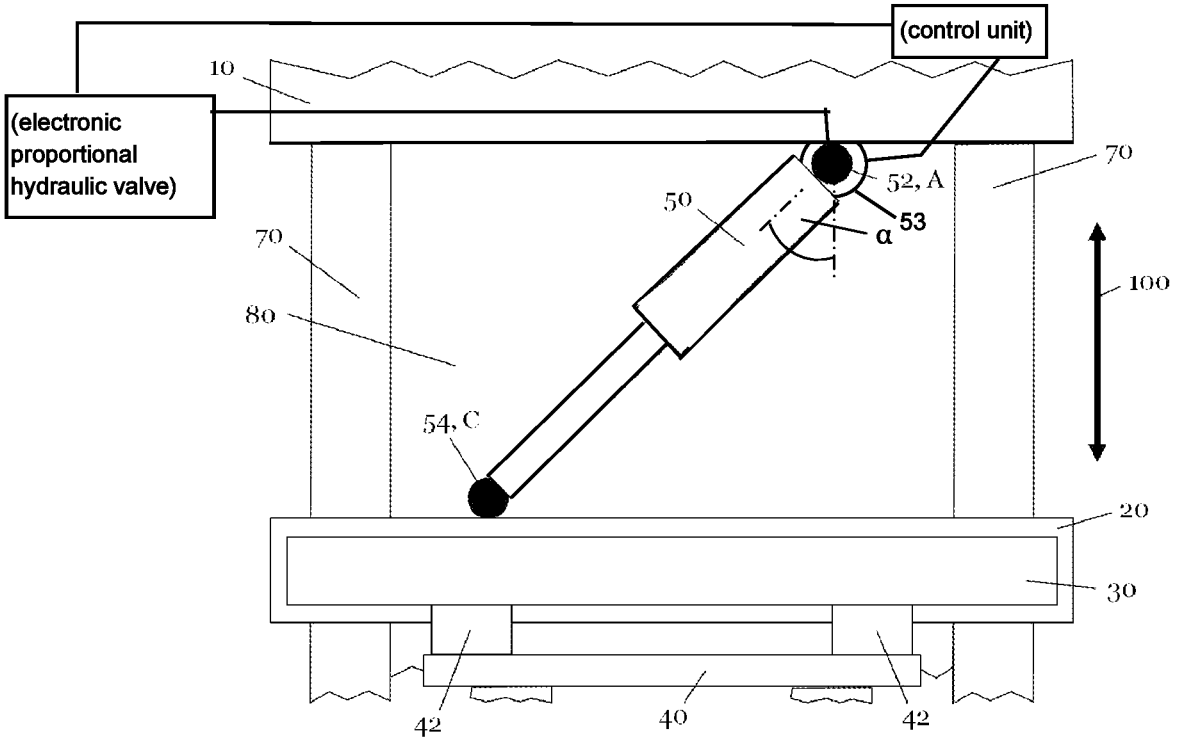
Figure 3:
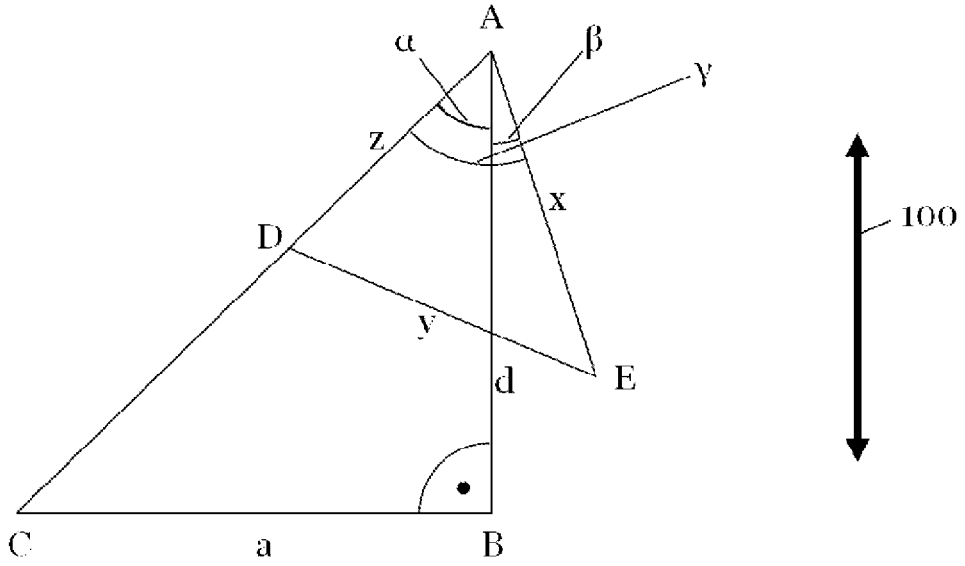
Figure 4A:
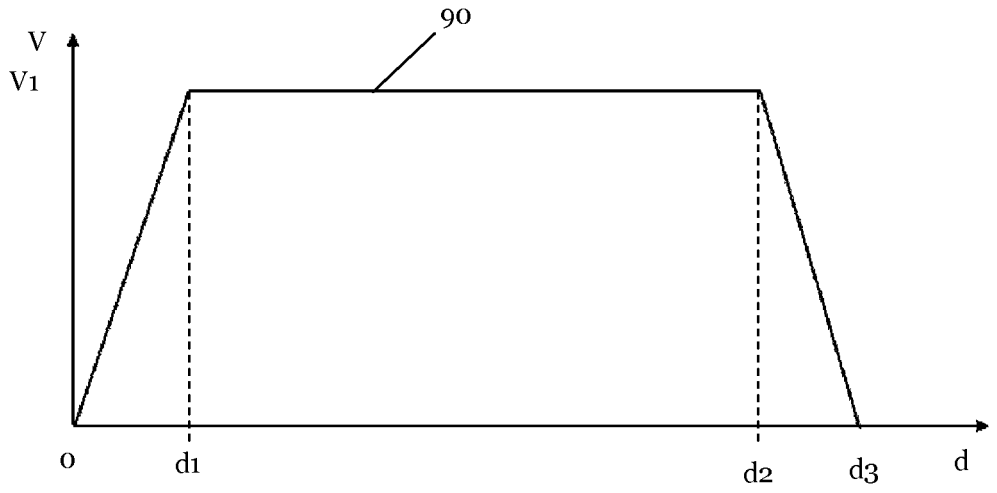

In the following, preferred embodiments of the present invention are disclosed by the use of the accompanying figures, in which shows:

FIG. 1*a* is a schematic side view of a reach truck according to an embodiment of the invention, wherein the mast trolley is located near to a main body;

FIG. 1*b* a schematic side view of the reach truck of FIG. 1*a*, wherein the mast trolley is located spaced apart from the main body;

FIG. 2*a* a schematic top view of the arrangement of a linear actuator and a length measuring device according to an embodiment of the invention, when the mast trolley is located spaced apart from the main body;

FIG. 2*b* a schematic top view of the arrangement of FIG. 2*a*, when the mast trolley is located near to the main body;

FIG. 2*c* a schematic top view of another arrangement, when the mast trolley is located near to the main body;

FIG. 3 a sketch, which describes the mathematic correlations of the length, which is determined by the length measuring device, with a first angle and a position of the mast trolley along the longitudinal axis relative to the main body of the reach truck;

FIG. 4*a* a diagram of a first v/d-profile of the mast trolley; and

Figure 4B:
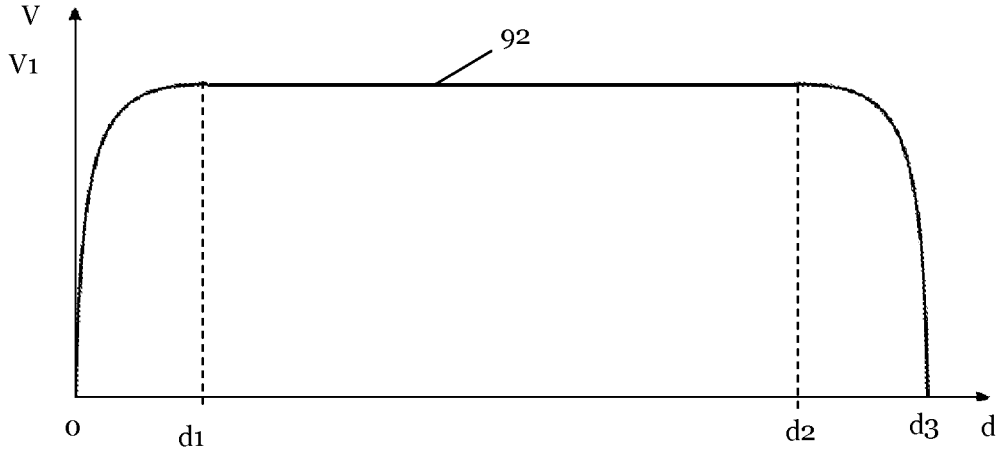

FIG. 4*b* a diagram of a second v/d-profile of the mast trolley.

5. PREFERRED EMBODIMENTS OF THE INVENTION

In the following, preferred embodiments of the invention are explained in detail with respect to the figures. However, it is obvious for the person skilled in the art that features of specific embodiments may be also provided to other embodiments, even if this is not explicitly shown in following explanations:

FIG. 1*a* shows a schematic side view of a reach truck 1 according to the invention, wherein the mast trolley 20 is located near to a main body 10. In FIG. 1*b* the mast trolley 20 is located spaced apart from the main body 10. The reach truck 1 comprises a main body 10 comprising an overhead guard 12, a steering member 14, wheels 16, a control unit, an energy source and a drive for one or more of the wheels 16. In the embodiment of FIGS. 1*a* and 1*b*, a user sits on the main body 10, where he or she is protected by the overhead guard 12 in view of falling goods. The steering member 14 is connected to the control unit, wherein the user is able to control the reach truck 1 by the steering member 14. The steering member 14 may be any suitable steering device like a joystick, a keyboard, a mouse, a touchscreen, paddles and the like. The reach truck 1 furthermore comprises three or more wheels 16, wherein at least one wheel 16 is driven and may be rotated around a vertical axis, in order to change the driving direction of the reach truck.

Moreover, the reach truck 1 comprises two load arms 70 protruding from the main body 10 to the front and thus defining a longitudinal axis 100 of the reach truck 1. However, it is obvious for the person skilled in the art, that the inventive concept of the present invention may be also realized in a reach truck 1 with a different configuration of the front. In the embodiment of the present invention, the load arms 70 are arranged symmetrically to each other. For the sake of stability and for the sake of handling convenience it is advantageous to maximize the distance between the two load arms 70 that support the front wheels 16 at their outermost end. In between the load arms 70 a base plate 80 is provided in order to provide further stability and in order to provide fixation members as desired. The base plate 80 and the load arms are members of and integral with the main body 10 of the reach truck 1.

The reach truck 1 furthermore comprises a mast trolley 20, which is slide-able on the load arms 70, in particular on tracks (not shown), which are provided at the load arms 70. A mast 30 is attached to the mast trolley 20, wherein the mast provides a vertical actuator 42 for extending the mast and for shifting a fork 40 in the vertical direction.

FIG. 2*a* shows a schematic top view of the arrangement of a linear actuator 50 and a length measuring device 60 according to one embodiment of the invention. In FIG. 2*a* the mast trolley 20 is located spaced apart from the main body 1 whereas in FIG. 2*b* the mast trolley 20 is located near to the main body 10. A first end 52, A of the linear actuator 50 is hinged to the main body, particularly to the base plate 80 by means of a hinge comprising a vertical hinge axis. A second end 54, C of the linear actuator is hinged to the mast trolley 20 by means of a hinge comprising a vertical hinge axis. When the linear actuator 50 extends the mast trolley 20 moves forward along the longitudinal axis 100. The linear actuator 50 is arranged inclined by an angle α to the longitudinal axis 100 of the reach truck 1. During an extension movement of the linear actuator 50, the first angle α between the extension direction of the linear actuator 50 and a longitudinal axis 100, which goes through the first end 52, A of the linear actuator 50, decreases. This angular movement of the linear actuator 50 corresponds to the movement of the mast trolley 20 along the longitudinal axis 100 of the reach truck 1 relative to the main body 10. Thus, the angular position of the linear actuator 50 can be used as a variable value for the determination of the actual position of the mast trolley 20 relative to the main body 10.

In the embodiment of FIG. 2*a* the angular position of the linear actuator 50 is determined by a length measuring device 60, which is hinged at a first end 62, E thereof to the main body 10 by means of a hinge comprising a vertical hinge axis. At a second end 64, D of the length measuring device 60 it is hinged to the linear actuator 50 by means of a hinge comprising a vertical hinge axis.

In the embodiment of FIG. 2*a* the linear actuator 50 is a hydraulic piston. Supply tubes (not shown) supply hydraulic liquid from a pump assembly (not shown) for extending and retracting the hydraulic piston 50.

As it can be seen from a comparison of FIGS. 2*a* and 2*b* the length of the length measuring device 60 changes. Particularly, the distance between a reference point of the base plate (namely the position of 62, E of the length measuring device 60) and a reference point at the linear actuator 50 (namely the second end 64, D of the length measuring device 60) changes, when the mast trolley 20 is moved. In this preferred embodiment, the length measuring device 60 is arranged on the base plate 80 of the main body 10 and below the mast trolley 20, so that the mast trolley is able to move freely above the length measuring device 60.

In the embodiment of FIG. 2*c*, the angular position of the linear actuator 50 is directly determined by an angle sensor 53, attached at first end 52, A. In other embodiments, the angle sensor 53 may be attached at or near second end 54, C. Angle sensor 53 is in communication with a control unit. Angle sensor 53 is configured to directly measure the angle "α".

FIG. 3 shows a sketch, which describes the mathematic correlations of a length "y", which is measured by the length measuring device 60, with a first angle "α" and a position "d" of the mast trolley along the longitudinal axis 100 relative to the main body 10 of the reach truck 1. "A" designates the first end 52 of the linear actuator 50. "B" designates a point, which is the projection of "A" along the longitudinal axis 100 to the mast trolley 20. "C" designates the position of the second end 54 of the linear actuator 50, which is attached to the mast trolley 20. "D" designates the position of the second end 64 of the length measuring device, which is hinged at the linear actuator 50, preferably at the cylinder of the piston. "E" designates the first end 62 of the length measuring device 60, which is hinged to the base plate 80. "a" marks the distance between "B" and "C". The distance "a" is defined during the design of the reach truck 1 and does not change during movement. "d" designates the distance between A and B, wherein "d" also characterizes the position of the mast trolley 20 relative to the main body 10. "d" is perpendicular to "a". "x" designates the distance between A and E. "x" is defined during the design of the reach truck 1 and does not change during movement. "y" is the length, which is detected by the length measuring device 60. "y" is the distance between the first end 62 of the measuring device 60 and the second end 64 of the measuring device 60. "z" designates the distance between A and D. "z" is defined during the design of the reach truck 1 and does not change during movement. "α" designates the first angle between the line segment AC and the line segment AB. "α" varies depending on "d", i. e. the position of the mast trolley along the longitudinal axis 100. "β" designates a second angle between the line segment AB and the line segment AE, wherein β is also defined during the design of the reach truck 1 and does not change during movement. "γ" designates a third angle between the line segment AC and line segment AE, so that $$\gamma=\alpha+\beta$$

results. "α" is calculated from "y" by the following equation:

$$\alpha = \arccos\left(\frac{x^2+z^2-y^2}{2xz}\right)-\beta.$$

The position "d" of the mast trolley 20 along the longitudinal axis 100 is calculated from "α" as follows:

$$d = \frac{a}{\tan\alpha}.$$

The above-mentioned calculations are carried out by the control unit (not shown), which is preferably arranged in the main body 10. The result of the calculations, i.e. the values "α" or "d", are preferably used for a position control and/or a speed control of the mast trolley 20.

FIGS. 4*a* and 4*b* show diagrams of a first and a second v/d-profile of the mast trolley 20, wherein v designates the speed of the mast trolley 20 during its movement relative to the main body 10 and "d" is the position of the mast trolley 20 along the longitudinal axis 100. FIG. 4*a* shows a speed profile 90, wherein the maximum allowable speed increases linearly in a range from 0 to a position $d_1$ up to a maximum speed $V_1$ and wherein the speed of the mast trolley 20 also decreases linearly from a position $d_2$ when the end of the admissible range of movement $d_3$ is reached. This speed profile limits the maximum allowable speed of the mast trolley at both ends of the movement ranges and provides a soft stop of the movements at the end positions.

FIG. 4*b* shows another speed profile 92, wherein the maximum speed of a mast trolley 20 increases exponentially up to the maximum speed $V_1$. At the end of the admissible range of movement $d_3$ of the mast trolley 20, the speed of the mast trolley 20 decreases exponentially down to zero. Such a speed profile again limits the maximum allowable speed of the mast trolley at both ends of the movement ranges and provides a soft stop of the movements at the end positions but provides an overall faster movement of the mast trolley from one end position to the other end position.

LIST OF REFERENCE SIGNS

1 reach truck
10 main body
12 overhead guard
14 steering member
16 wheels
20 mast trolley
30 mast
40 fork
42 vertical actuator
50 linear actuator
52, A first end of the linear actuator
54, C second end of the linear actuator
60 length measuring device
62, E first end of length measuring device
64, D second end of length measuring device
70 load arms
80 base plate
90 speed profile
92 speed profile
100 longitudinal axis

The invention claimed is:

1. A reach truck, comprising: a main body;

at least one load arm that protrudes from the main body;

a mast trolley that is supported at the at least one load arm, wherein the mast trolley is shift-able along a longitudinal axis of the reach truck relative to the main body;

a mast that is attached to the mast trolley;

a linear actuator configured to shift the mast trolley along the longitudinal axis of the reach truck relative to the main body; wherein the linear actuator is attached at a first end thereof to the main body and at a second end thereof to the mast trolley; and the linear actuator is arranged inclined to the longitudinal axis of the reach truck and defines a first angle between the extension direction of the linear actuator and the longitudinal axis of the reach truck, wherein the first angle changes depending on the position of the mast trolley relative to the main body; and the reach truck further comprises a sensor communicating with a control unit, wherein the control unit is configured to determine the angular position of the linear actuator.

2. A reach truck according to claim 1, wherein the linear actuator comprises a hydraulic piston that is controlled by an electronic proportional hydraulic valve.

3. A reach truck according to claim 2, wherein the sensor comprises a length measuring device that is hinged at a first end thereof to the main body and at a second end thereof to the linear actuator.

4. A reach truck according to claim 1, wherein the sensor comprises a length measuring device that is hinged at a first end thereof to the main body and at a second end thereof to the linear actuator.

5. A reach truck according to claim 4, wherein the measuring direction of the length measuring device differs from the extension direction of the linear actuator.

6. A reach truck according to claim 1, wherein the position of the mast trolley along the longitudinal axis of the reach truck relative to the main body is calculated as follows:

$$d = \frac{a}{\tan\alpha},$$

wherein a is a distance between the longitudinal axis that goes through the first end of the linear actuator and the second end of the linear actuator, and a is the angle between the extension direction of the linear actuator and the longitudinal axis of the reach truck.

7. A reach truck according to claim 1, wherein the first angle is calculated as follows:

$$\alpha = \arccos\left(\frac{x^2 + z^2 - y^2}{2xz}\right) - \beta$$

wherein

α is the angle between the extension direction of the linear actuator and the longitudinal axis of the reach truck;

x is a distance between the first end of the linear actuator and the first end of a length measuring device;

y is a length, which is detected by the length measuring device, and which is a distance between the first end of the measuring device and the second end of the measuring device;

z is a distance between the first end of the linear actuator and the second end of the length measuring device in the extension direction of the linear actuator; and β is a second angle, which is the angle between the longitudinal axis of the reach truck, which goes through the first end of the linear actuator, and x.

8. A reach truck according to claim 1, wherein the control unit controls a movement speed of the mast trolley based on the position of the mast trolley along the longitudinal axis of the reach truck relative to the main body.

9. A reach truck according to claim 8, wherein the control unit calculates the position of the mast trolley along the longitudinal axis of the reach truck relative to the main body from information received from the sensor.

10. A reach truck according to claim 9, wherein the control unit automatically controls a maximum movement speed of the mast trolley based on the position of the mast trolley along the longitudinal axis of the reach truck relative to the main body according to a predetermined profile.

11. A reach truck according to claim 1, wherein the sensor is an angle sensor.

12. A reach truck according to claim 11, wherein the angle sensor is attached near to the first end or near to the second end of the linear actuator.

13. A reach truck according to claim 1, wherein the angular position of the linear actuator and/or the position of the mast trolley along the longitudinal axis of the reach truck relative to the main body is continuously detected during movement of the mast trolley.

14. A reach truck according to claim 13, wherein the control unit continuously controls the maximum movement speed of the mast trolley based on the continuously detected position of the mast trolley along the longitudinal axis of the reach truck.

* * * * *